United States Patent [19]

Fengels

[11] 4,159,840

[45] Jul. 3, 1979

[54] LOAD-CARRYING NET FOR SUSPENSION EXTERNALLY OF AIRCRAFT SUCH AS HELICOPTERS

[75] Inventor: Gerd Fengels, Hagen, Fed. Rep. of Germany

[73] Assignee: Brüggemann & Brand KG, Fed. Rep. of Germany

[21] Appl. No.: 837,882

[22] Filed: Sep. 29, 1977

[30] Foreign Application Priority Data

Sep. 30, 1976 [DE] Fed. Rep. of Germany ..... 2644044

[51] Int. Cl.[2] ..... B66C 1/12

[52] U.S. Cl. ..... 294/77

[58] Field of Search ..... 294/77, 74, 75, 76, 294/67 E, 67 EA; 105/469, 467

[56] References Cited

U.S. PATENT DOCUMENTS 2,813,745 11/1957 Frieder et al. ..... 294/77

3,011,820 12/1961 Frieder et al. ..... 294/77

3,084,966 4/1963 Higgins ..... 294/77

*Primary Examiner*—James B. Marbert

*Attorney, Agent, or Firm*—Robert E. Burns; Emmanuel J. Lobato; Bruce L. Adams

[57] ABSTRACT

A load-carrying net comprises a network of interwoven belts provided with suspension rings for use in suspending the net from suspension tackle of an aircraft, particularly a helicopter. The net has a central load-supporting portion and opposed pairs of arms which are provided with the suspension rings and which radiate outwardly from the central portion. At least some load-carrying ones of the belts are each secured at their ends in an opposed pair of the arms and extend freely through the central portion so that they can make a sliding adjustment in the central portion for load equalization purposes.

16 Claims, 5 Drawing Figures

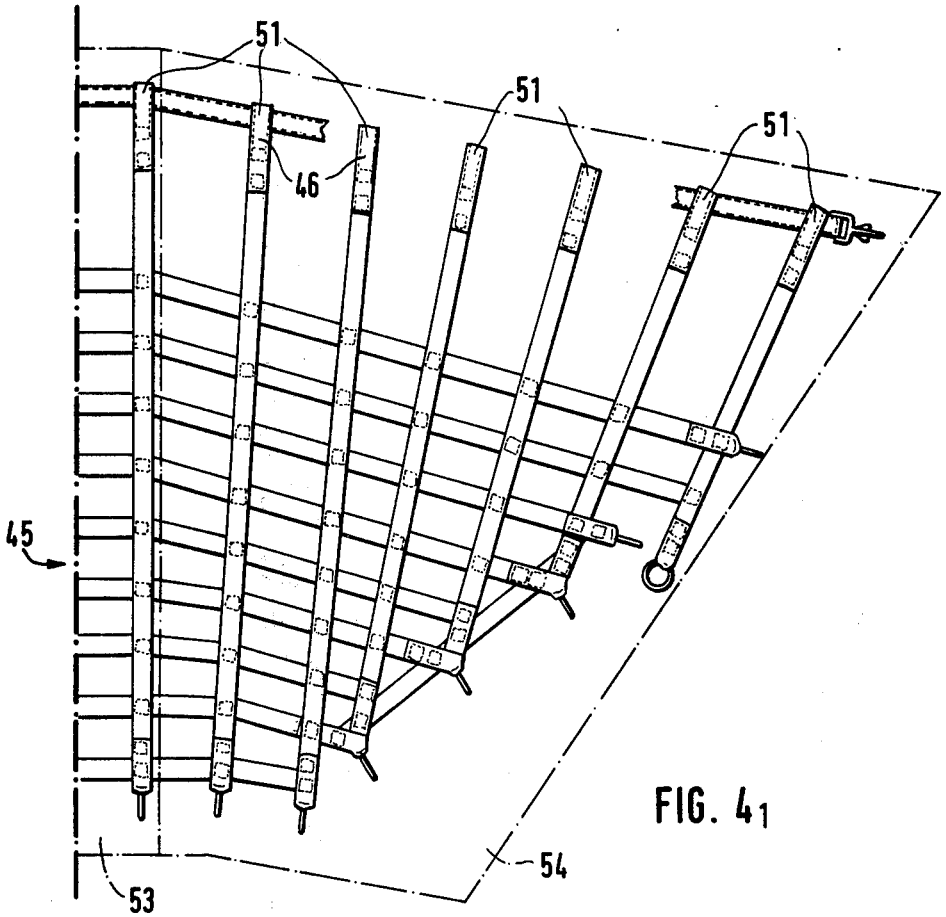
FIG. 4₁

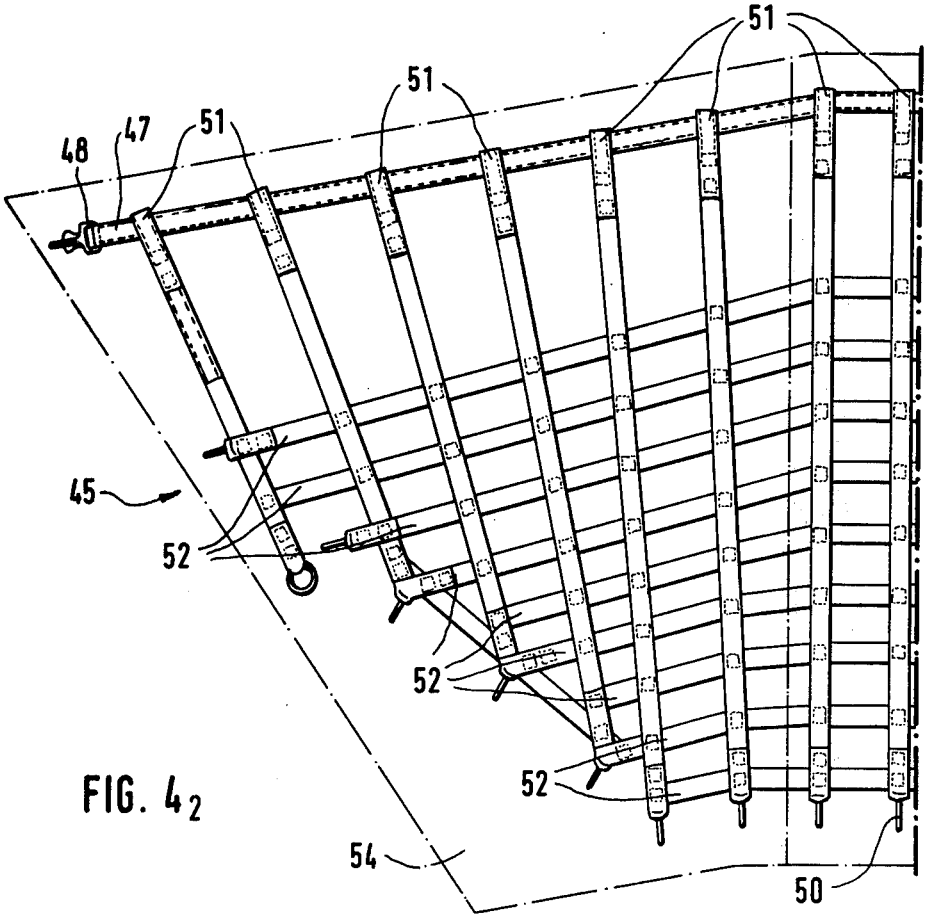
FIG. 4₂

LOAD-CARRYING NET FOR SUSPENSION EXTERNALLY OF AIRCRAFT SUCH AS HELICOPTERS

The invention relates to a load-carrying net for suspension externally of aircraft such as helicopters, the net comprising a network of interwoven belts provided with suspension rings for use in suspending the net from suspension tackle of an aircraft. Such a net, which is hereinafter referred to as of the kind described, is useful for carrying suspended loads of various kinds, size, shape and volume.

Transport nets made of belts are known and disclosed in DBGM No. 7,126,149 for example. These nets of square, round or other shape, consist of groups of flat warp and weft belts extending longitudinally and transversely, which are rigidly connected to one another, for example by a seam, at their points of intersection. These nets are bounded laterally by marginal belts into which the flat belts of the warp and weft thread structure merge at their ends where they are provided with loops. Furthermore, it is known to weave diagonal belts into the warp and weft structure, which diagonal belts extend between the individual net rings. The only function of these diagonal belts, however, is to strengthen the warp and weft structure in the diagonal direction in which the tensile forces primarily act when the load in the net is filled. Like the warp and weft belts, they are likewise sewn at the points of intersection of the flat belts.

With a favorable spacing of the individual belts, such rectangular nets are suitable for lifting an external load of about 4 ton. These nets, which have a relatively large loading area with a relatively low net weight, have only a low loading capacity.

It is the object of the invention to provide a transport net for aircraft which has a more favorable ratio of net weight or packing volume to the permissible loading capacity.

In order to solve this problem, the invention arises from the appreciation that in the known transport nets, in general, not all the belts are uniformly loaded, but generally some of them have to carry the main load. Since a low value is automatically set as the permissible loading capacity for this reason, there is the possibility, provided it is possible to load all the belts uniformly, of increasing the carrying capacity of the net decisively with the same net weight of the net and packing volume. Therefore the invention proposes a form of net which enables the supporting surface to be adapted to the surface occupied by the load so that the load is uniformly distributed over the whole supporting area.

According to the invention, in a net of the kind described, the net has a central load-supporting portion and opposed pairs of arms which are provided with the suspension rings and which radiate outwardly from the central portion, at least some load-carrying ones of the belts each being secured at their ends in an opposed pair of the arms and extending freely through the central portion so that they can make a sliding adjustment in the central portion for load equalization purposes.

As a result of the fact that the load-carrying belts are not sewn, for example, at their points of intersection but can be displaced within the freedom of movement permitted by their interweaving and connection by loops and rings, an automatic adaption of the arrangement of the belts to the particular loading nature of the net takes place. The radiating arm construction of the net is particularly effective as a result of the fact that, because of the arms of the net surrounding the load, an optimum adaption to the shape of the load is possible, with simultaneous support over a large area. Furthermore, with a net with radiating arms, an adaption of the belts extending in the direction of the ray arms can be better achieved than if the transport net were square or round, for example. Thus, as a result of suitable arrangement of the load-carrying belts which can slide freely inside the central supporting area, it becomes possible to load all the belts of the external load net uniformaly so that, as experiments have shown, the carrying capacity of the net can easily be increased to 9 ton with the same net weight. Thus a considerably better relative ratio of net weight or packing volume to permissible loading capacity can be achieved.

Each arm may have two primary ones of the load-carrying belts extending one along each edge of the arm, the ends of the primary belts of one arm being looped and connected by rings to the respective primary belts of the opposite arm in the central portion to allow a mutual angular adjustment of the connected primary belts.

In this manner, the effect is achieved that the primary load-carying belts can be displaced inside the central portion of the net representing the main supporting area and so can adapt themselves to the load. It is possible that the relative angular position of the individual arms may vary in relation to one another, without stresses occurring or unwanted bulges or the like forming in the net structure.

In order to ensure an optimum adaptation of the net, when the net has four equiangularly spaced arms, the connection rings preferably each lie on a center line of the other pair of arms and are connected to one another by four diagonal belts which can adjust angularly relatively to one another and to their points of interconnection.

Furthermore, each pair of opposed arms may additionally be connected to one another by secondary ones of the load-carrying belts firmly secured, for example sewn, at their ends to transverse belts of the arms but otherwise interwoven with the other belts.

Although a considerably better connection of the individual arms to one another is achieved in this manner, the free adjustability of the secondary belts, particularly in relation to the transverse belts to which they are not secured, within the individual arms, renders possible an optimum adaptation of the net to the particular load.

Each arm may be additionally connected to the opposite arm by a further belt which is slidable through a number of guide points, and are movable in relation to the other belts. These further belts are preferably connected to the arms far outside the central portion of the net, adjacent to the suspension rings which are adjacent to the outer ends of the arms.

Preferably, the further belts of each opposed pair of arms are formed by one endless belt, which is slidable as a whole.

In this manner, in particular, a load equalization can be effected between the individual arms directly at the tips of the arms, the interweaving of the individual belts only opposing a displacement of the endless belt to a limited extent.

In one construction, each endless belt for each pair of arms passes through guide points provided by the two connection rings on the center line of that pair of arms and four guide rings disposed one at each edge of each of that pair of arms adjacent to the suspension rings, in such a manner that it extends from one connection ring to one guide ring on the adjacent arm, from there across the central portion to the guide ring on the corresponding edge of the opposite arm, then through the other connection ring and in a symmetrical manner through the two other guide rings and back to the first connection ring.

In this manner, the endless belt in each arm extends in the direction towards the ring at the transition from the primary load-carrying belts to the suspension points of the net in the form of acute-angle triangles. Thus it is possible to divide up the tensile forces, which act in the endless belts, in such a manner that an optimum distribution of the loading of the arms in their particular surface and an equalization of the loading of the arms between one another is possible.

In order to prevent the equalization movement of the belts from being blocked by sharp pointed loads resting thereon or by an uneven base, provision may be made for chafing mats, for example in the form of coconut matting, to be disposed and detachably secured below and above the central portion of the net forming the load surface.

Furthermore, it is desirable that the equalization of the belts with one another takes place primarily in the central portion of the net. Accordingly, connecting belts which are non-adjustably connected to one another may be disposed between each adjacent pair of arms adjacent to the central portion for increasing the load supporting area of the net and limiting the maximum separation of the adjacent arms, the connecting belts being connected by rings to transverse belts of the arms. Thus no load equalization takes place in the region of these connecting belts, which are continued in the transverse belts round the central portion of the net, but an additional stabilization of the arms is achieved.

The means for connecting the connecting belts to one another may consist of outwardly radiating belts which extend perpendicularly, and are secured, to the connecting belts, and which are also connected at their inner ends to the transverse belt rings except for a central one of the radiating belts which extends freely through the central portion and continues as the corresponding central radiating belt at the opposite side of the central portion. These radiating belts may be sewn to the connecting belts.

In order to extend the net, particularly for carrying course bulk material or bags in the gaps situated between adjacent arms, corner nets may be securable to the arms, or to the arms and the outer connecting belts between adjacent arms. These corner nets preferably extend substantially out along the arms as far as points beyond which the arms are provided with the suspension rings. They may be formed from a network consisting of a plurality of corner net belts which cross over, and are non-adjustably secured, to one another. Preferably the corner net belts include some belts which radiate outwards from the central portion and which, at their inner ends, are provided with hooks for hanging in rings carried by the remaining portion of the net.

If the central portion of the net is enlarged by connecting belts and radiating belts, then the corner net may comprise a central rectangular portion and two lateral trapezoidal portions.

In order to achieve an adaptation of the shape of the net to the particular load, a marginal belt, the ends of which are provided with means for connection to suspension tackle of an aircraft, may extend through loops situated at the free edge of the each corner net. When the marginal belt is pulled, on lifting the load, the loops are pulled together in the manner of a drawstring, and the corner net adopts a shape corresponding to the load.

Although, in general, no corner nets are used for carrying piece goods, but securing belts may then be provided with load-securing belts for threading through rings carried by the arms. Nevertheless, the corner nets are suitable, in some circumstances, for carrying piece goods, such as containers.

An example of a net constructed in accordance with the invention is illustrated in the accompanying drawings, in which.

Figure 1:
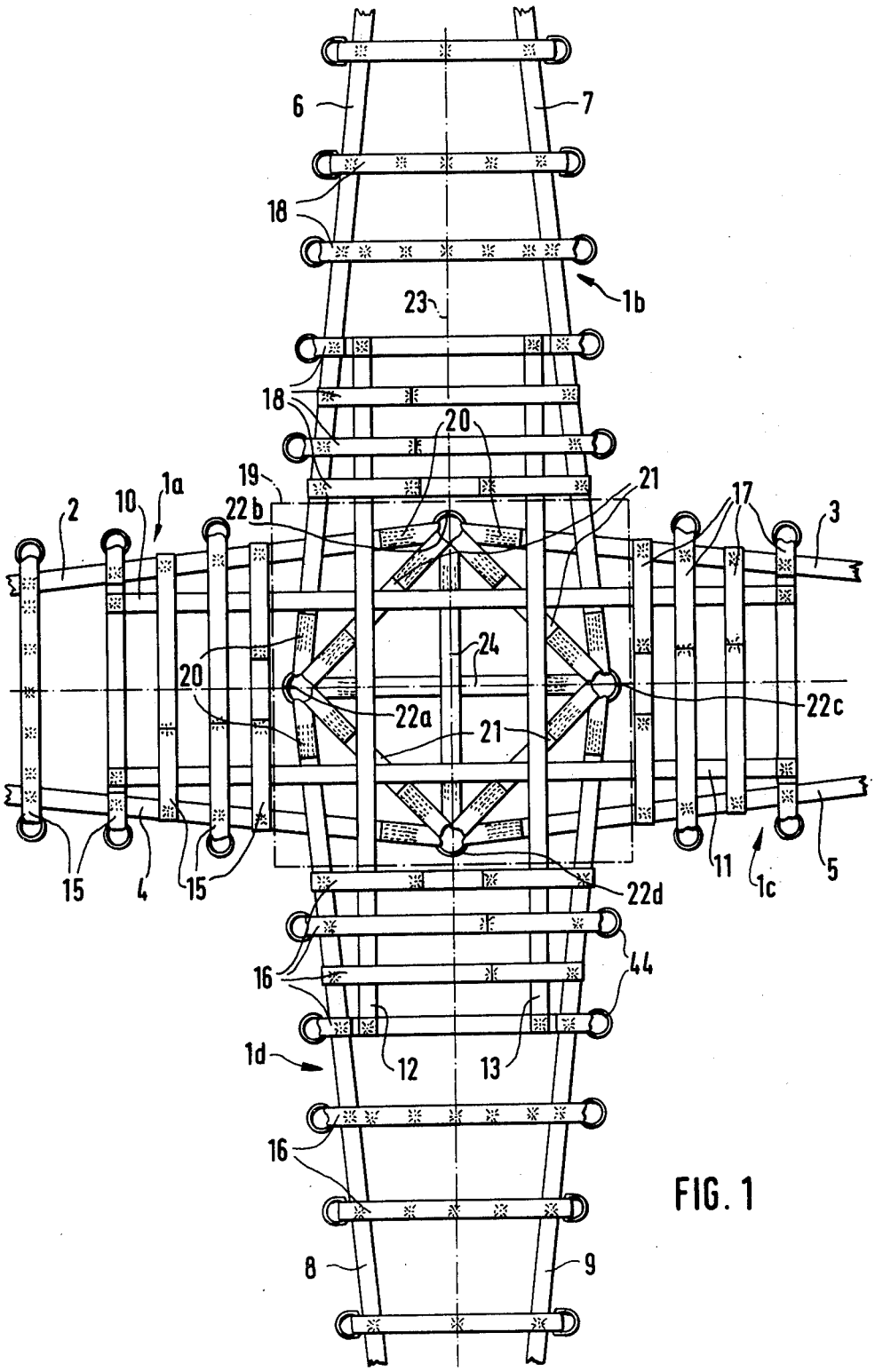
FIG. 1 shows the basic network of a central part of the net, showing primarily the primary and secondary load-carrying belts and the transverse arm belts.

The illustrated net 1 is represented as a four-armed structure.

The four arms 1*a*–1*d* are constructed in the form of isosceles triangles and each two 1*a*, 1*c*; 1*b*, 1*d* of which are situated opposite one another are a mirror image of one another. The net structure in the region of intersect on 19 of the arms 1*a*–1*d* consists of primary load-carrying belts 2–9 bounding the edges of the arms 1*a*–1*d*, four connection rings 22*a*–22*d* which connect these and are fitted on the center lines 23 of the arms, diagonal belts 21, further diagonal belts 24 connecting the opposite rings 22*a*, 22*c*; 22*b*, 22*d* and secondary load-carrying belts 10–13 extending between opposite arms 1*a*, 1*c*; 1*b*, 1*d* from attachment points outside the region of intersection 19.

The ends of the primary load-carrying belts 2–9 are each mounted for displacement and rotation in the rings 22*a*–22*d* by means of loops 20. A rotation and displacement of the arms 1*a*–1*d* in relation to one another in the region of intersection 19 representing the central load-supporting portion of the net is achieved in particular as a result of the fact that the belts 2–9 can slide freely in relation to one another at their points of intersection. The mounting and displacement of the arms in relation to one another is achieved as a result of the fact that the two abutting ends of the corresponding belts 2–9 of opposite arms are directly connected by a ring 22*a*–22*d* and loops 20 and that the ends of adjacent arms are connected indirectly by the diagonal belts 21 and 24 holding the rings 22*a*–22*d* at a maximum distance apart. What is important is that the belts 21 and 24 engage with loops in the rings 22*a*–22*d* so that a rotation and displacement of the ends of the belts is possible in the rings 22*a*–22*d*.

This, like the sliding guiding of the primary load-carrying belts 2–9 at their points of intersection, already mentioned, contributes to the angular adjustment of the arms 1*a*–1*d* in relation to one another without tension and without forming bulges or the like in the supporting surface. From this point of view, it is further important that the secondary belts 10–13, which extend in the longitudinal direction through the arms and are each sewn by their end points to a transverse belt 15–18, like the belts 21, are not sewn to other belts or to one another but can slide freely for load equalization adjustment purposes. As can be seen from FIG. 1 for the basic net structure and also from FIG. 2 for the completed net, all the belts in the central portion 19 of the net are free to slide in relation to one another in such a manner that their freedom of movement is only limited by the interweaving and the arrangement of their loops, present at one end, in common rings.

Thus, on the one hand an optimum distribution of the loading of the belts can be achieved by the radiating basic shape of the net with arms which are wrapped round the goods being transported, and on the other hand by a special construction of the region of intersection of the arms representing the central portion forming the loading surface.

The equalization of the loading in the central portion of the net is facilitated, in particular, by the fact that flat belts and no ropes are interwoven therein. Ropes would actually cut into one another, if they should move in relation to one another under loading, which might make further sliding impossible or would at least lead to early wear of the net.

Figure 2:
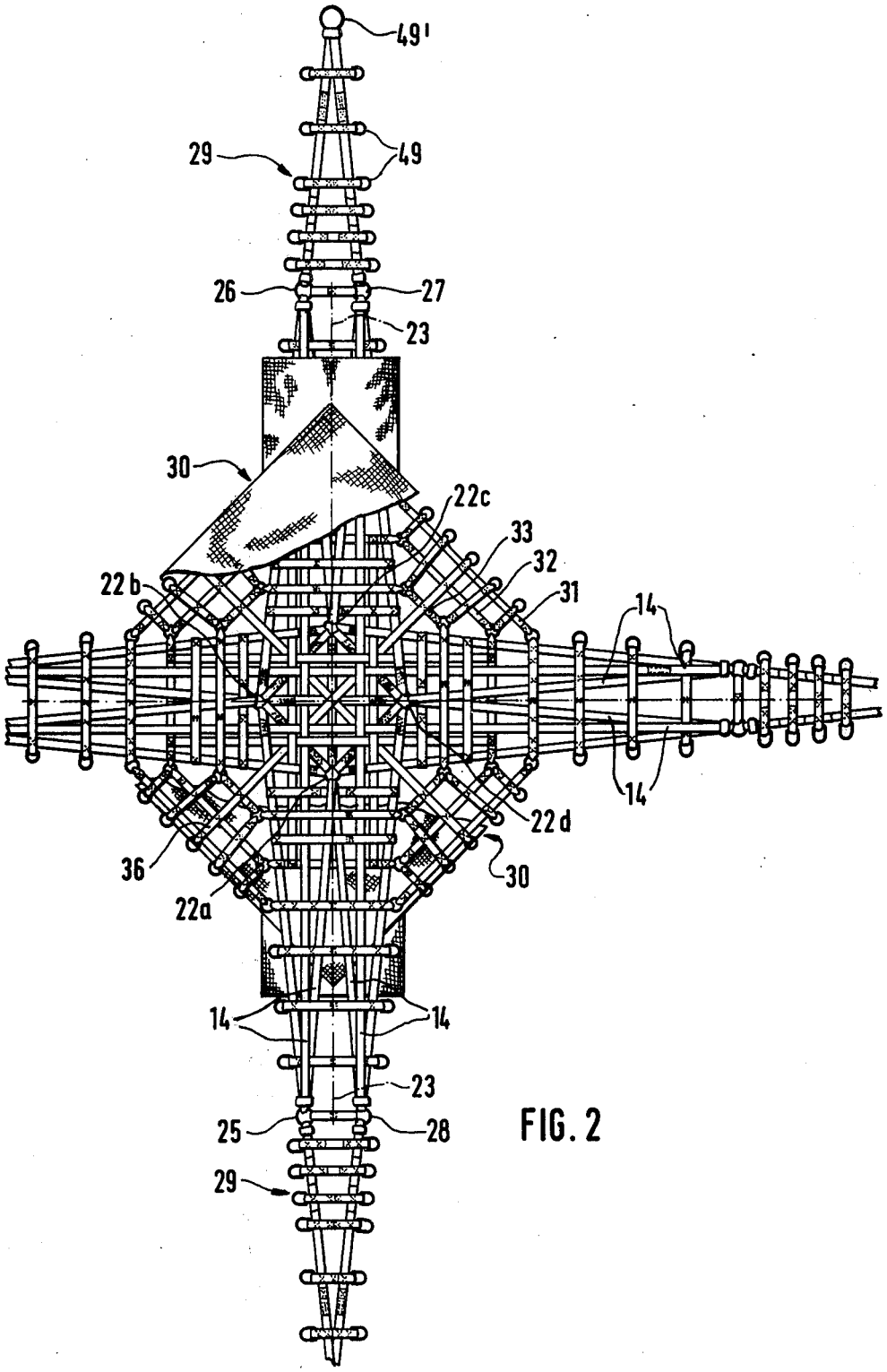
FIG. 2 shows part of the completed net.

FIG. 2 shows, in the completed net structure of FIG. 1, an endless belt 14 which extends as a loop from the arm 1*a* close to the tip 29 of the arm to the opposite arm 1*c*. In the course of this, it not only connects the four rings 25–28, which are connected to the primary load-carrying belts 2–5 and hence to the connection of the tip 29 of the arm by means of suspension rings 49 and $\mathbf{49}_1$ which establish the connection to the aircraft lifting or suspending tackle such as a winch hook, but also the connection rings 22*a–*22*d* holding the end loops 20 of the belts 2–9 in the central portion of the net. In this manner the belt 14 in each arm 1*a–d* extends in the direction in which the load is transmitted to the tips 29 of the net, in the form of acute-angled triangles. Thus the tensile forces of the load in the belt web 14 are distributed in such a manner that an optimum distribution of the loading of the arms 1*a–d* takes place and an equalization of any unequal loading of the arms is effected.

Figure 3:
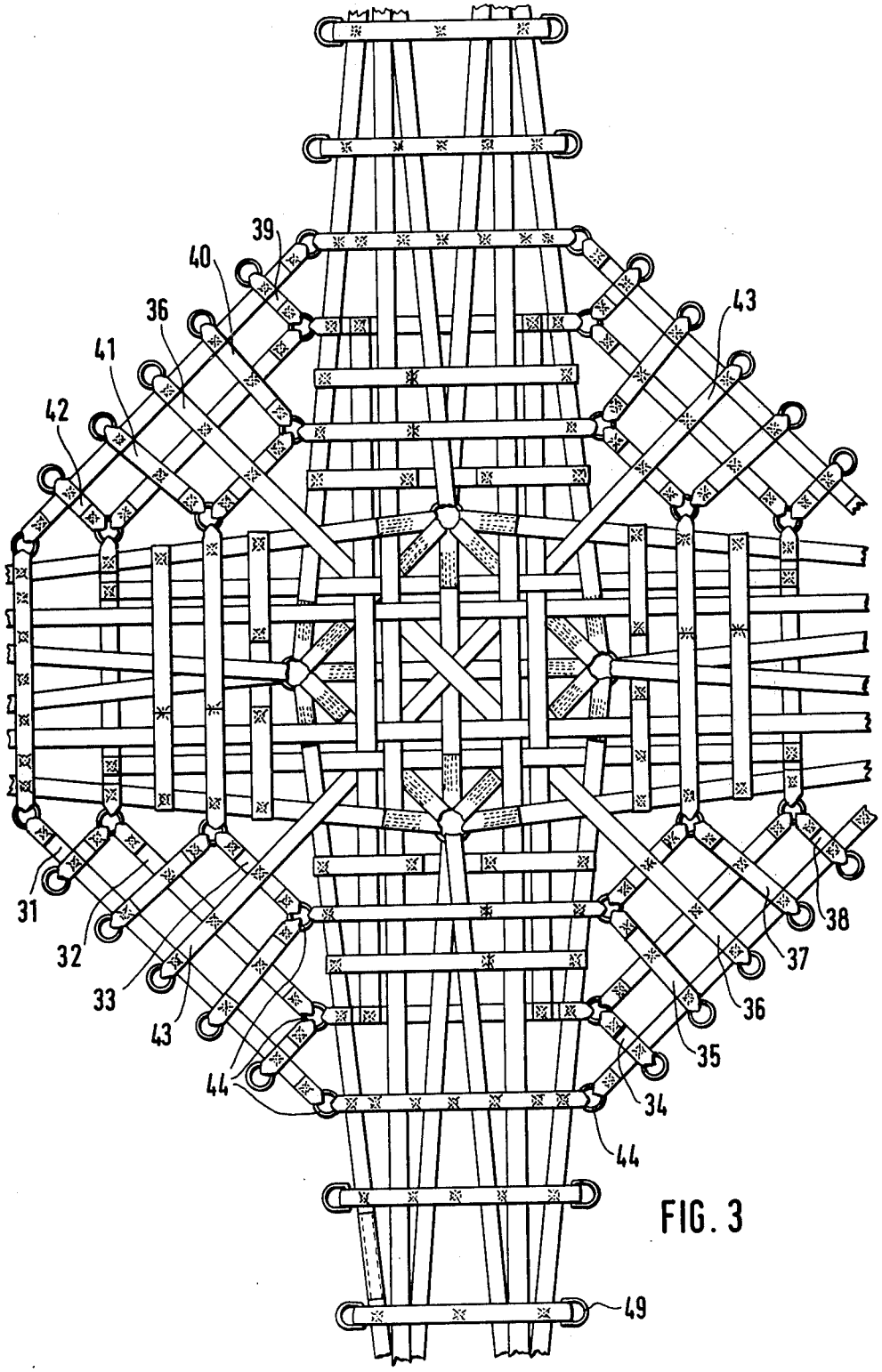
FIG. 3 shows the completed network of the central part of the net but to an enlarged scale and turned through 90° in relation to FIG. 2; and FIGS. $4_1$ and $4_2$ show the two halves of a corner net.

As can be seen in particular from FIG. 3, connecting belts 31–33, which are secured to corresponding rings 44 of the transverse belts 15–18, are fitted between adjacent arms 1*a, b;* 1*b, c;* 1*c, d;* and 1*d, a,* in the vicinity of the central portion 19 of the net in each case. The connecting belts 31–33, which extend parallel to one another, form, with corresponding transverse belts 15–18, a belt connection extending externally round the central portion of the net. As a result, a maximum spacing of the arms 1*a–d* is determined. A rotation and displacement of the arms 1*a–d* in relation to one another can therefore take place mainly only in the central portion 19 of the net, while the relative position of the arms 1*a–d* remains unaltered in the region of the connecting belts 31–33.

The connecting belts 31–33 are rigidly connected to one another by transverse radiating belts 34–43 sewn onto them. Except for a pair of central belts 36, 43, of the radiating belts these are likewise connected to the rings 44 of the transverse belts 15–18 by the rings 44. The central radiating belts 36, 43, on the other hand, slide freely through the central portion 19 of the net and then continue as the corresponding central radiating belt at the opposite side of the central portion.

At their other ends, the belts 34–43 comprise rings which, like the D-rings 49 on the transverse belts 15–18, which do not carry any rings 44, serve to secure a corner net 45 which, in contrast to the connecting belts 31–33 and radiating belts 34–43, is not intended to enlarge the central portion of the actual loading surface but is used, in particularly, with bulk material, bags and the like, to stabilize this material laterally and to transfer the lateral forces into the arms 1*a–d.* Thus it represents an extension of the net by means of which the gap between adjacent arms is filled in.

Such a corner net is illustrated in FIG. 4. It is hung, inter alia, on the outer connecting belt 31 and consists of a central rectangular section 53 and two lateral, substantially trapezoidal sections 54. Furthermore, it consists of a network of a plurality of load-carrying belts 51, which radiate in relation to the central portion of the net and are connected by transverse belts 52 which cross them and are sewn thereto. At their ends, they comprise hooks 50 and loops 46. Taken through the loops 46 is a marginal belt 47, the two ends 48 of which can be suspended from the aircraft tackle. If the net, with the load, is lifted, for example by the rising helicopter, then the marginal belt 47 is pulled and so the loops 46 are pulled together in the manner of a drawstring i.e. like the eyes of a rucksack. The hooks 50, on the other hand, are connected to the net arms 1*a–d* or to the outer connecting belt 31.

During the transport of bulky goods, such as containers, the fitting of corner nets is generally superfluous. Instead, securing ropes are used which are generally simpler in construction and are stretched between and threaded through the D-rings 49.

In order to prevent sharp-edged goods from cutting into the belts of the supporting surface, a chafing mat 30 is preferably provided over the belts. As a result of this protection against chafing, which is preferably constructed in the form of coconut matting, a mutual displacement of the equalizing belts is possible even under extreme loading. In order to prevent blocking of the belts from the under side of the supporting surface, a protection against chafing is preferably likewise fitted from this side.

I claim:

1. A load-carrying net for suspension externally of aircraft such as helicopters, said net comprising: a network of interwoven belts provided with suspension rings for use in suspending said net from suspension tackle of an aircraft, said net having a central load-supporting portion and opposed pairs of arms which are provided with said suspension rings and which radiate outwardly from said central portion, at least some load-carrying ones of said belts each being secured at their ends in an opposed pair of said arms and extending freely through said central portion so as to make a sliding adjustment in the central portion for load equalization purposes, each arm being additionally connected to the opposite one of said arms by a further belt which is slidable through a number of guide points, said further belts being connected to said arms at the ends thereof adjacent to said suspension rings, and said suspension rings being disposed adjacent to the outer ends of said arms.

2. A net according to claim 1, wherein each arm has two primary ones of said load-carrying belts extending one along each edge of said arm, the ends of said primary belts of one arm being looped and connected by connection rings to the respective primary belts of the opposite one of said arms in said central portion to allow a mutual angular adjustment of said connected primary belts.

3. A net according to claim 2, wherein there are four equiangularly spaced ones of said arms, and wherein said connection rings each lie on a center line of the other pair of said arms and are connected to one another by four diagonal belts which can adjust angularly relatively to one another and to their points of interconnection.

4. A net according to claim 2, wherein each opposed pair of said arms has secondary ones of said load-carrying belts secured at their ends to transverse belts of said arms.

5. A net according to claim 1, wherein said further belts of each opposed pair of said arms are formed by one endless belt which is slidable as a whole.

6. A net according to claim 5, wherein each arm has two primary ones of said load-carrying belts extending one along each edge of said arm, the ends of said primary belts of one arm being looped and connected by connection rings to the respective primary belts of the opposite one of said arms in said central portion to allow a mutual angular adjustment of said connected primary belts, wherein there are four equiangularly spaced ones of said arms, wherein said connection rings each lie on a center line of the other pair of said arms and are connected to one another by four diagonal belts which can adjust angularly relatively to one another and to their points of interconnection, and wherein said endless belt for each pair of said arms passes through guide points provided by said two connection rings on the center line of that pair of arms and four guide rings disposed one at each edge of each of that pair of arms adjacent to said suspension rings, in such a manner that said endless belt extends from one of said connection rings to one guide ring on the adjacent one of said arms, from there across said central portion to said guide ring on the corresponding edge of the opposite one of said arms, then through the other one of said connection rings and in a symmetrical manner through the two other ones of said guide rings and back to said first one of said connection rings.

7. A net according to claim 1, wherein chafing mats are disposed and detachably secured below and above said central portion.

8. A net according to claim 1, wherein a group of connecting belts, which are non-adjustably connected to one another, are disposed between each adjacent pair of said arms adjacent to said central portion for increasing the load supporting area of said net and limiting the maximum separation of said adjacent pair of arms, said connecting belts being connected by rings to transverse belts of said arms.

9. A net according to claim 8, wherein said connecting belts are non-adjustably interconnected by outwardly radiating belts which extend perpendicularly, and are secured, to said connecting belts, and which are also connected at their inner ends to said transverse belt rings except for a central one of said radiating belts which extends freely through said central portion and continues as the corresponding central radiating belt at the opposite side of said central portion.

10. A net according to claim 1, wherein corner nets, which each form an extension of said net in the gaps situated between an adjacent pair of said arms, are each removably secured in said corresponding gap to the adjacent edges of said net.

11. A net according to claim 10, wherein said corner nets extend substantially out along said arms as far as points beyond which said arms are provided with said suspension rings.

12. A net according to claim 10, wherein a marginal belt, ends of which are provided with means for connection to suspension tackle of an aircraft, extends through loops situated at the free edge of each of said corner nets.

13. A net according to claim 10, wherein each corner net is formed from a network consisting of a plurality of corner net belts which crossover, and are non-adjustably secured, to one another.

14. A net according to claim 13, wherein said corner net belts include some belts which radiate outwards from said central portion and which, at their inner ends, are provided with hooks for hanging in rings carried by the remaining portion of said net.

15. A net according to claim 8, wherein corner nets, which each form an extension of said net in the gaps situated between an adjacent pair of said arms, are each removably secured in said corresponding gap to the adjacent edges of said net, and wherein each of said corner nets consists of a central rectangular portion and two lateral trapezoidal portions.

16. A net according to claim 1, which is provided with load-securing belts for threading through rings carried by said arms.

* * * * *